US007421232B2

(12) United States Patent
Kreiter

(10) Patent No.: US 7,421,232 B2
(45) Date of Patent: Sep. 2, 2008

(54) DEVICE AND METHOD FOR INKING OF A CHARGE IMAGE WITH TONER MATERIAL IN A PRINTER OR COPIER

(75) Inventor: Alexander Kreiter, Wörth (DE)

(73) Assignee: Oce Printing Systems GmbH, Poing (DE)

( * ) Notice: Subject to any disclaimer, the term of this patent is extended or adjusted under 35 U.S.C. 154(b) by 206 days.

(21) Appl. No.: 11/342,039

(22) Filed: Jan. 27, 2006

(65) Prior Publication Data

US 2006/0177240 A1 Aug. 10, 2006

(30) Foreign Application Priority Data

Jan. 28, 2005 (DE) ..... 10 2005 004 125

(51) Int. Cl.
*G03G 15/08* (2006.01)
*G03G 15/00* (2006.01)

(52) U.S. Cl. ..... 399/234; 399/164

(58) Field of Classification Search ..... 399/234, 399/235, 162–165
See application file for complete search history.

(56) References Cited

U.S. PATENT DOCUMENTS 4,383,497 A 5/1983 Tajima
5,623,717 A 4/1997 Takenaka et al.
5,890,042 A * 3/1999 Wong et al. ..... 399/285
6,519,434 B2 * 2/2003 Izumi et al. ..... 399/223
6,556,802 B2 * 4/2003 Sasamoto et al. ..... 399/299
6,775,505 B2 * 8/2004 Stelter et al. ..... 399/267

FOREIGN PATENT DOCUMENTS

| | | |
|---|---|---|
| DE | 43 42 060 | 6/1994 |
| DE | 103 54 347 | 8/2005 |
| EP | 1 154 332 | 11/2001 |
| EP | 1 178 361 | 2/2002 |
| EP | 1 213 621 | 6/2002 |

* cited by examiner

*Primary Examiner*—Ryan Gleitz
(74) *Attorney, Agent, or Firm*—Schiff Hardin LLP

(57) ABSTRACT

In a device and method for inking of a charge image with toner material in a printer or copier, the charge image corresponding to a print image to be generated is generated on a surface of a photoconductor element comprising a photoconductive layer. At least one layer made up of toner particles is applied on a region of a surface of an applicator element. The surface of the photoconductor element is contacted by at least one part of the toner particles applied on the surface of the applicator element.

12 Claims, 6 Drawing Sheets

DEVICE AND METHOD FOR INKING OF A CHARGE IMAGE WITH TONER MATERIAL IN A PRINTER OR COPIER

BACKGROUND

The preferred embodiment concerns a device and method for inking of a charge image with toner material in a printer or copier. The surface of a photoconductor element comprises a photoconductive layer on which a charge image can be generated corresponding to a print image to be generated. The device also comprises an applicator element on whose surface a layer made up of toner particles has been applied in at least one region.

Developer stations in known printer or copier systems for development of charge images generated on a photoconductor, i.e. for development of latent print images, are used for implementation of image development methods in which the charge image is inked with toner across a gap. Such image development methods are known, for example, from U.S. Pat. No. 4,383,497. In known developer stations as they are often used in high-capacity printers, applicator elements are frequently provided in order to pass toner material past the charge image to be developed. The applicator elements are advantageously applicator rollers or continuous belts. A uniformly thick layer made up of toner particles that are charged and electrostatically adhere to the surface of the applicator element is applied on the surface of the applicator element in the developer station.

The charge image is located on a photoconductor, for example a photoconductor band or a photoconductor drum. The regions of the charge image to be inked are inked with the toner particles present on the surface of the applicator element. With the aid of an alternating voltage applied between the photoconductor and the applicator element, the toner particles electrostatically adhering to the surface of the applicator element are released from the surface of the applicator element in the region before, after and in the air gap via the alternating field generated with the aid of the alternating voltage, whereby what is known as a toner cloud is generated in this region. Due to a constant electrical field superimposed on the alternating electrical field, a force in the direction of the photoconductor is exerted on the toner particles contained in the toner cloud, whereby the toner particles are applied on the photoconductor corresponding to a charge image present there.

A concentrated application of toner material in the boundary regions of regions to be inked occurs in particular due to an excess supply of toner material in the toner cloud in the contact region between applicator element and photoconductor. Given a subsequent transfer and fixing of a toner image with boundary regions inked in a concentrated manner on a carrier material, a different optical density is generated in these boundary regions than in the rest of the regions to be inked.

The boundary regions inked in a concentrated manner are compacted upon transfer printing of the toner image from the photoconductor onto an intermediate carrier and upon transfer printing from this intermediate carrier onto a carrier material or from the photoconductor directly onto a carrier material, whereby adhesive forces are increased between the contact surfaces. These adhesive forces can pull toner material out from the boundary regions of the transferred toner image, which toner material than remains on the photoconductor or on the intermediate carrier. Toner material can thereby also be pulled out from the inner regions to be inked. Given transfer printing onto white paper, white areas (for example in characters to be inked) are created due to this pulled-out toner material. Due to their un-inked points inside the characters, such characters are also designated as hollow characters. The presence of un-inked regions is also designated as canes.

Given printers with high printing speed, the developer rollers must also be adjusted exactly in order to not select the distance to be bridged too large on the one hand and, on the other hand, to still keep the spraying of toner material (due to the air flows occurring in the gap) in a range in which only slight visible effects on the inked toner image result. In particular in high-capacity printers, circumferential speeds of the photoconductor element and of the applicator element in the range of >=1 m/s are typical. Toner particles can also remain adhered on the regions that are not to be inked due to the mentioned air currents, due to the generated toner cloud and due to the toner particles additionally applied in the boundary regions, which lead to what is known as spraying of the toner material. This spraying is also designated as spreading.

In order to also enable the exact adjustment of the gap between applicator element and photoconductor, highly-precise and exactly-adjustable components must be used, whereby a significant adjustment effort is additionally required. Particles and foreign bodies that are thicker than the developer gap lead at the least to the destruction of the photoconductor since both the position of the photoconductor and the position of the applicator element in the transfer region are fixed and the developer gap is mechanically limited.

The concentrated application of toner material in the boundary regions of regions to be inked also leads to more toner material being consumed than is absolutely necessary for generation of a high-quality print image.

Arrangements and methods for inking of charge images with toner material are known from the documents DE 43 42 060 A1, DE 103 54 347 A1, EP 1 213 621 A1, EP 1 154 332 and EP 1 178 361 A2.

SUMMARY

It is an object to specify a device and a method in which a concentrated inking of boundary regions of regions to be inked is provided as well as preventing a spraying of toner material on regions that are not to be inked.

In a method and device for inking of a charge image with toner material on a printer or copier, a charge image corresponding to a print image to be generated is generated on a surface of a photoconductor band comprising a photoconducting layer. A layer made up of toner particles is applied at least on one region of a surface of an applicator roller. The photoconductor band is pivoted towards the applicator roller in a transfer printing region between the photoconductor band and the applicator roller with aid of a pivot arrangement in order to transfer at least one part of the toner particles present on the surface of the applicator roller onto the photoconductor band. The photoconductor band is pivoted away from the applicator roller in the transfer printing region with the pivot arrangement in order to prevent transfer from the surface of the applicator roller onto the photoconductor band. The photoconductor band is directed over a first roller of the pivot arrangement before the transfer printing region. The photoconductor band is directed over a second roller of the pivot arrangement after the transfer printing region.

DESCRIPTION OF THE PREFERRED EMBODIMENT

Figure 1:
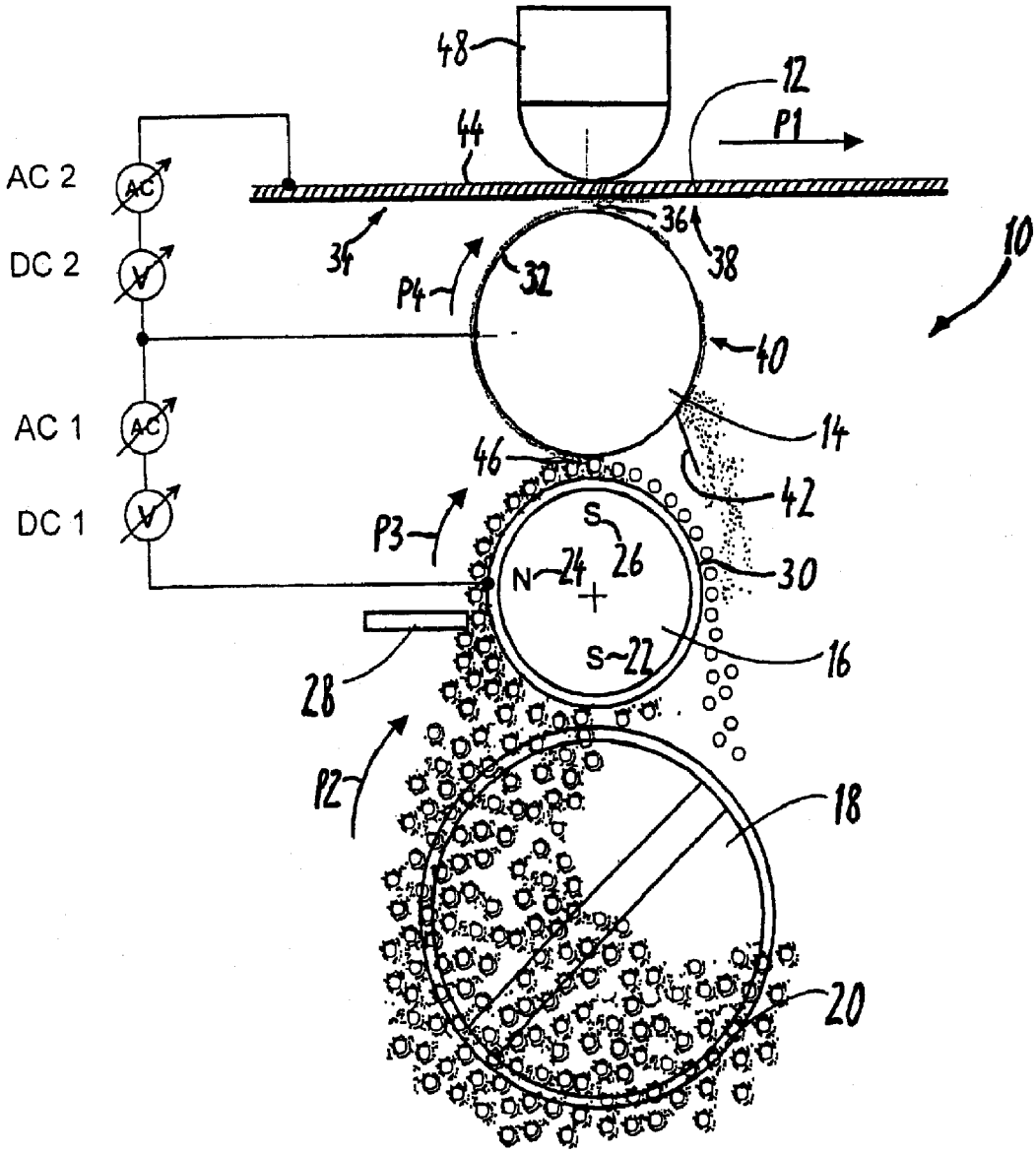
Fig. 1 (PRIOR ART)
FIG. 1 is a section representation of an arrangement for inking of a charge image present on a photoconductor band.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

Due to the direct contact of the toner particles of the toner particle layer applied on the applicator roller with the surface of the photoconductor band, the toner particles are no longer coercively detached from the surface of the applicator roller with the aid of an alternating field in order to be transferred onto the surface of the photoconductor band. The strength of the alternating field generated in the contact region can at least be significantly reduced relative to an alternating field required given the development across an air gap.

Due to a direct contact of the surface of the photoconductor band with the applicator roller, a support element at the transfer point can also be omitted, whereby objects that have a larger dimensioning than the height of a typical developer gap can pass the transfer printing point without damaging the applicator roller and the photoconductor band. Due to the device and the method of the preferred embodiment, the concentrated accumulations of toner particles in boundary regions of surfaces to be inked can also be avoided, whereby the spraying of toner particles as well as caries in the transfer printing of regions to be inked can be prevented in a simple manner. The toner consumption can be reduced with simultaneous increase of the print quality. Due to the direct contact of the photoconductor band with the toner particles located on the surface of the applicator roller, elaborate devices for adjustment of an exact air gap (i.e. developer gap) between the photoconductor band and the applicable roller must no longer be provided.

A section representation of an arrangement for inking with toner material of a charge image present on a photoconductor band 12 with the aid of a developer unit 10 is shown in FIG. 1. The photoconductor band 12 is driven with essentially constant speed in the direction of the arrow P1. The developer unit 10 comprises an applicator roller 14, a magnet roller 16 and a mixing wheel 18. The lower part of the mixing wheel 18 is located in what is known as a mixture sump 20 of the developer unit 10. A two-component mixture made up of electrically-charged toner particles and ferromagnetic carrier particles is contained in this mixture sump 20. The electrically-charged toner particles adhere to the ferromagnetic carrier particles. The carrier particles essentially serve to transport the toner particles to the applicator roller 14 with the aid of the magnet roller 16.

Three magnet elements 22, 24, 26 are arranged stationary inside the magnet roller 16. The magnet elements are permanent magnets (in particular natural magnets) that extend inside the roller 16 over its entire length. The longitudinal axes through the poles of the magnet elements 22, 24, 26 are radially aligned, whereby the south poles of the magnet elements 22 and 26 as well as the north pole of the magnet element 24 are aligned towards the roller surface. The counter-poles of the magnet elements 22, 24, 26 are not shown.

What are known as magnetic brushes (not shown) are formed on the surface of the magnet roller 16 in the region of the magnet elements 22, 24, 26, via which magnetic brushes raised accumulations made up of toner particles and carrier particles are formed. The ferromagnetic carrier particles together with toner particles adhering to these are held in the region of the magnet elements 22, 24, 26 by the magnetic field generated by these and are aligned along the resulting field lines of the magnetic fields, whereby a brush-shaped accumulation of toner particles and carrier particles is generated in the region of the magnetic poles.

The mixing wheel 18 is driven in the direction of the arrow P2, whereby the toner particles and carrier particles located in the mixture sump 20 are mixed. The toner particles are triboelectrically charged due to the friction generated in the mixing. The two-component mixture made up of toner particles and carrier particles is thrown or spun up to the magnet roller 16 due to the rotation movement of the mixing wheel 18, whereby a portion of the two-component mixture impacts on the surface of the magnet roller 16 and is in particular held on the surface of the magnet roller 16 due to the magnetic fields of the magnet elements 22 and 24. The mixture made up of toner particles and carrier particles is transported on the surface of the magnet roller 16 due to the movement of the magnet roller 16 in the direction of the arrow P2. The slice thickness of the layer of the two-component mixture located on the surface of the magnet roller 16 is limited by a scraper 28.

The magnet roller 16 comprises a metal sheath 30 that has been coated with a ceramic layer of a suitable roughness and thereby has good adhesion properties for transport of the two-component mixture. The metal sheath 30 is connected with a first potential of a direct voltage source DC1. The direct voltage source DC1 can be continuously adjusted, whereby the voltage of the direct voltage source DC1 is adjusted with the aid of a control unit. An alternating voltage AC1 that is generated with the aid of an alternating voltage source AC1 is superimposed on the direct voltage generated by the direct voltage source DC1. The alternating voltage generated with the aid of the alternating voltage source AC1 is advantageously preset as constant.

The applicator roller 14 comprises a metal sheath 32 that is connected with the second potential of the direct voltage source DC1 as well as with the second potential of the direct voltage source AC1. A constant electrical field and an alternating field superimposed on this constant electrical field are thus generated between the metal sheath 32, the applicator roller 14 and the metal sheath 30 of the magnet roller 16. The electrical fields are strongest at the point 46 with the smallest separation between the applicator roller 14 and the magnet roller 16. The alternating electrical field between applicator roller 14 and the magnet roller 16 effects a detaching of the toner particles from the carrier particles. The constant electrical field between the applicator roller 14 and the magnet roller 16 leads to a force being exerted on the toner particles in the direction of the applicator roller 14, such that the toner particles detached from the carrier particles attach to the applicator roller 14 as a uniform layer. The quantity of the toner particles detached from the two-component mixture and attaching to the applicator roller 14 is thereby dependent on the potential difference between the first potential and the second potential, i.e. essentially on the voltage generated by or due to the direct voltage source DC1.

The toner particles accumulated on the surface of the application roller 14 electrostatically adhere to this surface. The layer thickness of the toner particle layer generated on the applicator roller 14 can thus be adjusted in a simple manner via the adjusted voltage of a voltage source DC1. A charge image that corresponds to a toner image to be generated or to a print image to be generated is located in the region 34 on the photoconductor band 12. Such a charge image is also designated as a latent print image. The photoconductor band 12 is moved in the direction of the arrow P1. The applicator roller 14 is driven in the direction of the arrow P4 simultaneous with the movement of the photoconductor band 12. The circumferential speed of the photoconductor band 12 and the circumferential speed of the applicator roller 13 are essentially equal, such that essentially no speed difference occurs in the region of the transfer printing point 36 between photoconductor band 12 and applicator roller 14. Due to the movement of the photoconductor band 12 and the applicator roller 14, a relatively strong air current is generated in the air gap between the two elements. This air current can lead to the detachment of individual toner particles, whereby these toner particles accumulate on regions of the photoconductor band 12 that are not to be inked or are carried out from this gap and can be deposited on components of the printer or copier.

The regions of the charge image 34 to be inked are inked with toner material in the transfer printing region 36, whereby essentially the entire toner material layer located on the surface of the applicator roller, which toner material layer is situated opposite the region to be inked, is transferred onto the photoconductor band 12. The toner particles adhering on the applicator roller 14 are detached from its surface due to the alternating voltage DC2, whereby what is known as a toner cloud is created in the transfer printing region 36. The toner particles located in this toner cloud are then deposited on the regions of the photoconductor band 12 to be inked. More toner particles from the cloud are deposited in the boundary regions of the photoconductor band 12 to be inked than in the rest of the regions to be inked, since there toner particles are also available that are available due to the regions of the charge image that are not to be inked. These toner particles are transported to the regions to be inked due to the constant electrical field DC2.

A toner image on the photoconductor band 12 that essentially corresponds to the print image to be generated is thus located in the region 38 of the photoconductor band 12. A toner image that essentially corresponds in negative to the print image located in the region 38 remains behind in the region 40 on the applicator roller 14. The toner material still located on the surface of the applicator roller 14 is removed from this with the aid of a scraper 42. The removed toner material falls back into the mixture sump 20 and is thus available again for subsequent inking of the applicator roller 14.

The toner material still possibly present on the surface of the applicator roller 14 (in the regions from which toner material was removed for inking of the charge image and transferred onto the photoconductor band 12) is removed from the surface of the applicator roller 14 with the aid of the scraper 42. Further cleaning devices as they are in particular known from the international patent application WO 03/036393 A2 can be provided in addition or as an alternative to the scraper 42 for removal of the toner material remaining on the applicator roller 14 and for cleaning of the surface of the magnet roller 16. In the present patent application, the arrangements known from this patent application for inking and cleaning of applicator elements and magnet rollers are incorporated by reference into the present specification. The design and alternative designs of the recording medium 16 are also expressly described in this cited patent application. This disclosure is also herewith incorporated by reference into the present specification.

As already mentioned, an air gap between the surface of the applicator roller 14 and that of the photoconductor band 12 is provided in the transfer printing region 36. The development with toner material of the charge image present in the region 34 occurs across this air gap. The photoconductor band 12 comprises an electrically-conductive layer 44 that, as already mentioned, is connected with a second potential of a second direct voltage source DC2. The first potential of the direct voltage source DC1 is connected with the second potential of the direct voltage source DC2 and thus with the metal sheath 32 of the applicator roller 14. The constant electrical field between the electrically-conductive layer 44 and the metal sheath 32 is thus generated with the aid of the direct voltage source DC2, whereby a force in the direction of the surface of the photoconductor band 12 is exerted on the toner particles in the transfer printing region 36.

The direct voltage source DC2 can advantageously be continuously adjusted such that the strength of the constant electrical field between the metal sheath 32 and the electrically-conductive layer 44 can be adjusted and, if applicable, regulated in a large range. A support element 48 is provided at the transfer printing point 36, opposite the applicator roller 14; the back side of the photoconductor band 12 slides past this support element 48 in the transfer printing region 36. Such a support element 48 can, for example, have a ceramic surface, whereby the friction and the electrostatic charge are reduced at the support element 48. The support element 48 can also have a porous surface facing towards the back side of the photoconductor band 12, from which porous surface a defined air current can exit. The gap between the applicator roller 14 and the photoconductor band 12 can then be adjusted with the aid of the air current. Such an arrangement and such a method are expressly described in the German patent DE 102 33 189. The content of this patent is herewith incorporated by reference into the present specification.

Figure 2:
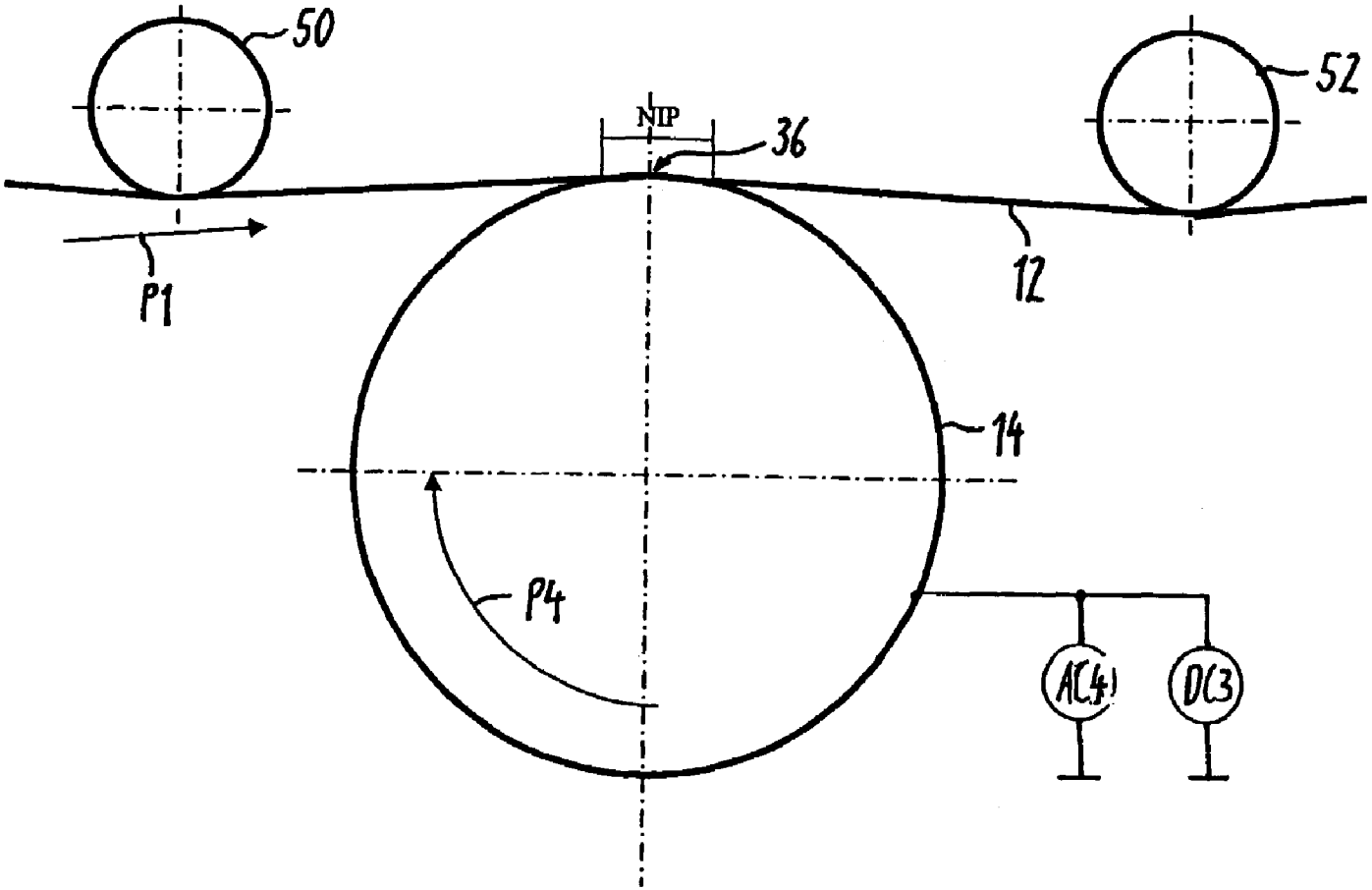
FIG. 2 is a section representation of an arrangement of the preferred embodiment for inking of a charge image present on a photoconductor band.

A section representation of an alternative arrangement for inking the charge image present on the photoconductor band with toner material that is located on the surface of the applicator roller 14 is shown in FIG. 2. In contrast to FIG. 1, at the transfer printing point 36 the photoconductor band 12 contacts the surface of the applicator element 14 or the layer of toner material present on the surface of the applicator element 14 in the transfer region 36. A roller 50 is arranged before the transfer printing point 36 and a roller 52 is arranged after the transfer printing point 36. The rollers 50, 52 serve to guide the photoconductor band 12 in the transfer printing region. 36, whereby the longitudinal axes of the rollers 50, 52 run essentially transverse to the transport direction P1 of the photoconductor band 12.

The rollers 50, 52 have essentially the same separation from the transfer printing point 36. Given the arrangement according to FIG. 2, a guidance element on the inner side of the continuous photoconductor band 12 opposite the transfer printing point 36 is not necessary. The applicator roller 14 is arranged such that, in the region between the rollers 50, 52, it pushes the photoconductor band 12 between these rollers. The photoconductor band 12 is pressed against the surface of the applicator roller 14 or against the toner layer located on this as a result of the belt tension. Due to the direct contact between photoconductor band 12 and applicator roller 14, an air gap is no longer present in the form as in an arrangement according to FIG. 1, in which a gap is present between applicator element 14 and photoconductor band 12. In the arrangement according to FIG. 2, the outer side of the photoconductor band 12 touches or contacts the surface of the applicator roller 14 along a section that results from the geometric arrangement of the rollers 50, 52 and 14. This section is designated with NIP in FIG. 2. In advantageous arrangements, the length of this section is in the range of 0.5 mm to 10 mm, advantageously in the range from 1 mm to 3 mm. The common tangent of the rollers 50, 52 on their undersides intersects the applicator roller 14. The largest distance of the surface of the applicator roller 14 in the region NIP from this tangent to a straight line orthogonal to the tangent is designated as an immersion depth of the applicator roller 14 in the photoconductor band 12.

Due to the direct contact between the toner particles present on the surface of the applicator roller 14 and the photoconductor band 12, such a strong alternating electrical field between the applicator roller 14 and the photoconductor band 12 (as is necessary in the arrangement according to FIG. 1) is no longer required. The toner particles are detached from the surface of the applicator roller 14 with the aid of an arrangement according to FIG. 2, even given a relatively weak alternating electrical field. Due to the lower alternating electrical field, a significantly smaller toner cloud or no toner cloud at all is generated in the contact region of the arrangement according to FIG. 2. The negative effects caused by a relatively large toner cloud (such as, for example, concentrated toner accumulations in the boundary regions of surfaces to be inked, excessive spraying of toner particles (what is known as spreading) as well as caries) are thus also prevented or at least significantly reduced. Given the arrangement according to FIG. 2, only the toner particle layer present on the surface of the applicator roller 14 is transferred to the regions of the photoconductor band 12 to be inked.

A non-uniform inking in a region to be inked is also prevented by the arrangement according to FIG. 2. The toner consumption is also reduced due to the prevention of the toner accumulation in the boundary region, what is known as the edge effect.

In the case in which particles (for example toner clumps, paper particles or parts detached from components of the printer or copier) get between applicator roller 14 and photoconductor band 12 in the transfer printing region 36, the photoconductor band 12 can simply be deflected further inwards (upwards) as a result of the guidance elements that are not present in the transfer printing region 36 (in contrast to FIG. 1), whereby its band tension is merely increased. However, the photoconductor band 12 is thereby not compulsorily destroyed, as this would be the case in the arrangement according to FIG. 1. In contrast to the arrangement according to FIG. 1, the elements according to FIG. 2 (in particular the applicator roller 14 and the guidance rollers 50, 52) have significantly larger concentricity tolerances and adjustment tolerances since a developer gap does not have to be exactly set and maintained. In the arrangement according to FIG. 1, the developer gap must essentially be set exactly, for example to 200 μm. The production costs of the individual elements in the arrangement according to FIG. 2 as well as the effort for setup and maintenance tasks can thereby be significantly reduced.

In the arrangement according to FIG. 2, in practical tests it has furthermore proven to be advantageous to charge [load] the developer roller with a voltage AC4 in the range of 800 to 1600 volts alternating voltage and a direct voltage DC3 in the range of −150 volts to −350 volts direct voltage relative to ground potential. In the arrangement according to FIG. 2, the alternating voltage AC4 also serves to detach the toner particles from the surface of the applicator roller 14. However, this alternating voltage AC4 can be significantly lower than the alternating voltage AC2 according to FIG. 1. Essentially no toner cloud that (as already described) would negatively affect the generated print image is thereby generated by the alternating voltage source AC4. It has proven to be particularly advantageous to charge the applicator roller 14 with an alternating voltage in the range of 1000 volts to 1300 volts.

Figure 3:
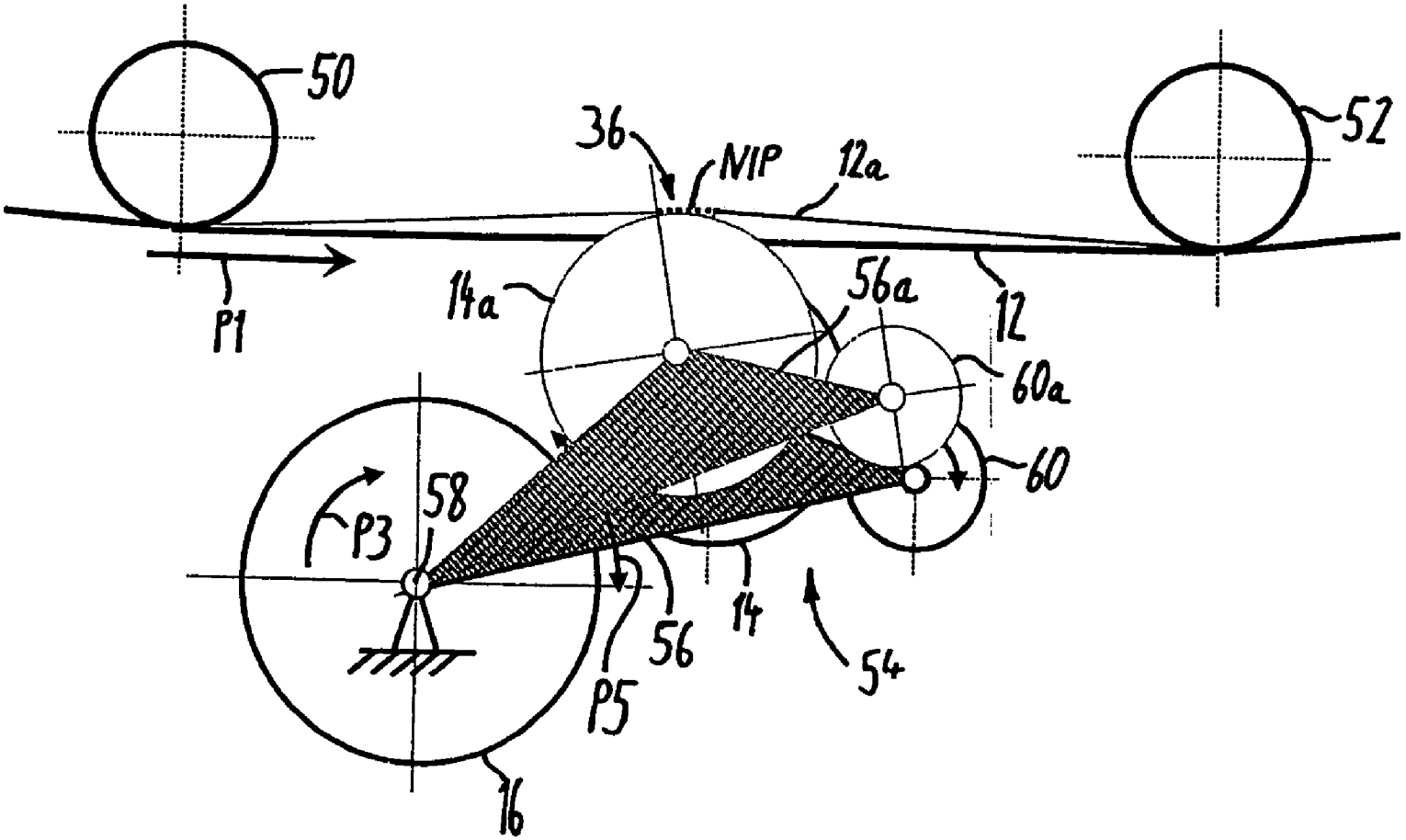
FIG. 3 is a section representation of an arrangement for inking of a charge image present on a photoconductor band with a pivotable applicator roller according to a first embodiment.

A section representation of an arrangement for inking of a charge image present on a photoconductor band 12 with toner material with the aid of toner particles that are present on the surface of an applicator roller 14 is shown in FIG. 3. In contrast to FIG. 2, the applicator roller 14 can be pivoted onto the photoconductor band 12 and can be pivoted away from this with the aid of a pivot arrangement 54. A pivot frame 56 is arranged such that it can rotate around a rotation axis 58 along the arrow P5. The applicator roller 14 is designated with the reference character 14 in the pivoted-away state and with the reference character 14*a* in the pivoted-towards state. In the same manner, the photoconductor band 12 is designated with 12 in the pivoted-away state of the applicator roller 14 and with 12*a* in the pivoted-towards state of the applicator roller 14*a*. The pivot frame 56 is designated with 56*a* in the pivoted-towards state.

The applicator roller 14 is fastened in the pivot frame 56 such that the position of the rotation axis of the applicator roller 14 is changed with panning of the pivot frame 56 along the arrow P5. In the arrangement according to FIG. 3, a cleaning roller 60 is also provided that is fixed in the pivot frame 56 such that the rotation axis of the cleaning roller 60 is mutually panned along the arrow P5 given panning of the pivot frame. The position of the cleaning roller 60 relative to the applicator roller 14 is thereby maintained in every position of the pivot frame 56. The cleaning roller 60 is a magnet roller that is designed similar to the magnet roller 16 according to FIG. 1.

A particle mixture made up of carrier particles and toner particles, with a relatively small fraction of toner particles, is transported on the surface of the cleaning roller 60, whereby this particle mixture is brought into contact with the surface of the applicator roller 14 via formation of a magnetic brush on the surface of the cleaning roller 60, such that these magnetic brushes are brought into contact with the toner particles on the surface of the applicator roller 14, which toner particles still remain on the surface of the applicator roller 14 after the passing of the transfer region 36. As already mentioned, after the transfer printing point 36 toner particles remain on the surface of the applicator roller in regions that essentially correspond to the negative of the generated print image.

The particle mixture that is transported on the surface of the magnet roller 16 is advantageously transported to the cleaning roller 60 after the transfer of toner particles from the particle mixture onto the surface of the applicator roller 14, whereby this particle mixture is then used (with the aid of the cleaning roller 60) to clean the toner particles remaining on the surface of the applicator roller 14. The change of the curve of the photoconductor band 12*a* relative to the curve of the photoconductor band 12 is also designated as deflection of the photoconductor band 12, whereby the amplitude of this deflection corresponds to the immersion depth of the applicator roller 14. The rotation point of the pivot arrangement 56 runs along the rotation axis 58 of the magnet roller 16. Due to this common rotation axis, the separation between the surface of the magnet roller 16 and the applicator roller 14 remains the same in every pivot position.

Figure 4:
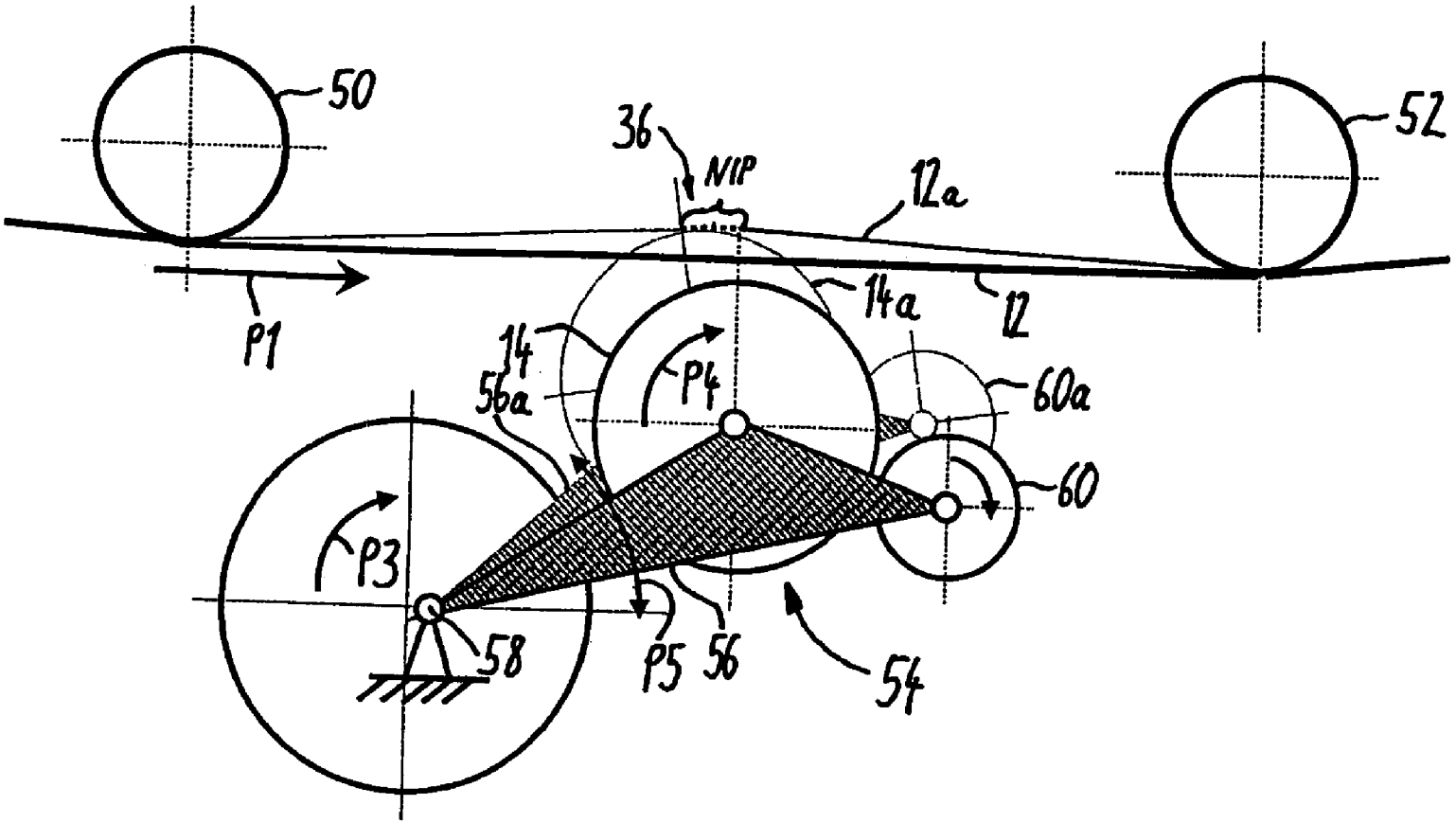
FIG. 4 is a section representation of an arrangement for inking of a charge image present on a photoconductor band with a pivotable applicator roller according to a second embodiment.

The arrangement according to FIG. 3 is shown in FIG. 4, whereby the pivot axis 58 of the pivot frame 56 does not coincide with the rotation axis of the magnet roller 16. The distance between the surface of the magnet roller 16 and the applicator roller 14 thereby changes upon pivoting. In the pivoted-away state, in which the surface of the applicator roller 14 does not contact the surface of the photoconductor band 12, the separation between the surfaces of the magnet roller 16 and the applicator roller 14 is enlarged relative to the pivoted-towards position, whereby then only a relatively small quantity of toner material or no toner material is deposited on the surface of the applicator roller 14.

The quantity of the toner particles to be removed from the surface of the applicator roller 14 in the pivoted-away state with the aid of the cleaning roller 60 can thereby be significantly reduced, whereby the toner material is then less loaded. Such a load is also designated as a stress of the toner material. The toner material is thus not as significantly stressed in the arrangement according to FIG. 4, in contrast to the arrangement according to FIG. 3. The properties of the toner material can thereby be held constant over a longer span of time, whereby the quality of the generated print images can also be held constant over a longer span of time.

Figure 5:
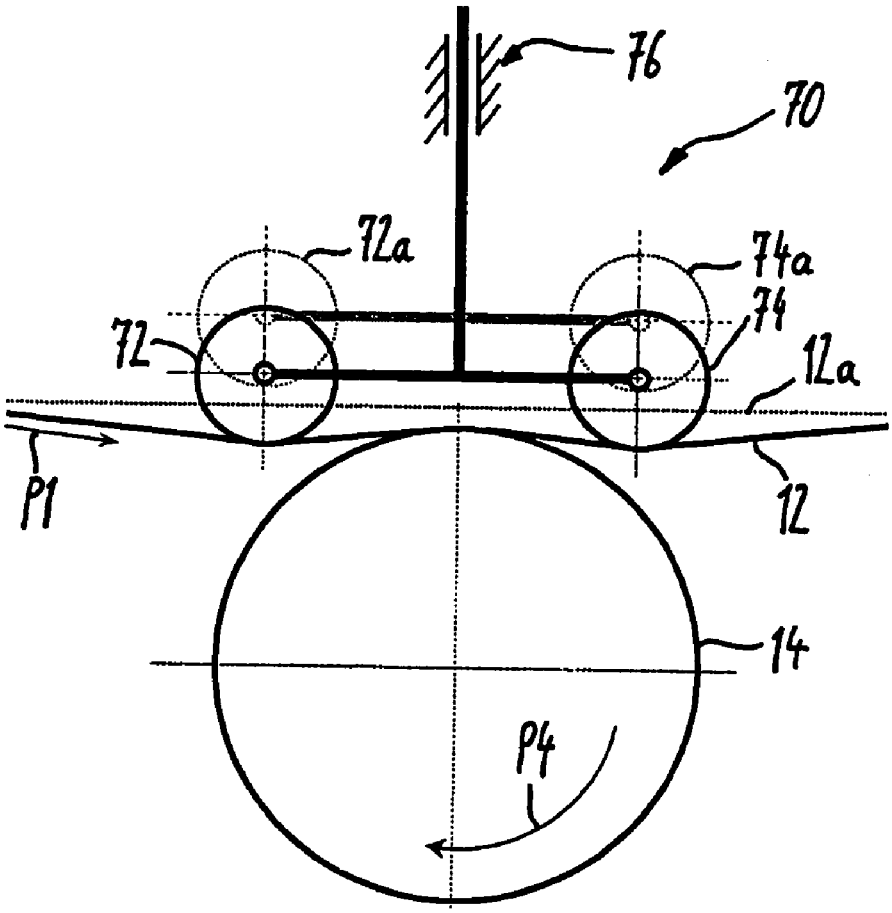
FIG. 5 is a section representation of an arrangement for inking of a charge image present on a photoconductor band with a device for directing the photoconductor band towards an applicator roller according to a first embodiment.

A section representation of a further arrangement for inking of charge images present on the photoconductor band 12 with the aid of the applicator roller 14 is shown in FIG. 5. In contrast to the arrangements according to FIGS. 3 and 4, in the arrangement according to FIG. 5 the photoconductor band 12 is directed towards the applicator roller 14. For this, in FIG. 5 an arrangement 70 with the rollers 72, 74 is provided that can bring the photoconductor band 12 from an operating state in which the photoconductor band 12 does not contact the surface of the applicator roller 14 into an operating state in which the surface of the photoconductor band 12 contacts the surface of the applicator roller 14. The. arrangement 70 is directed over a linear guide 76, such that given a movement of the arrangement 70 with the aid of an actuator (not shown) the rollers 72, 74 can be brought from the positions 72*a*, 74*a* into the positions designated with the aid of the reference characters 72, 74.

Figure 6:
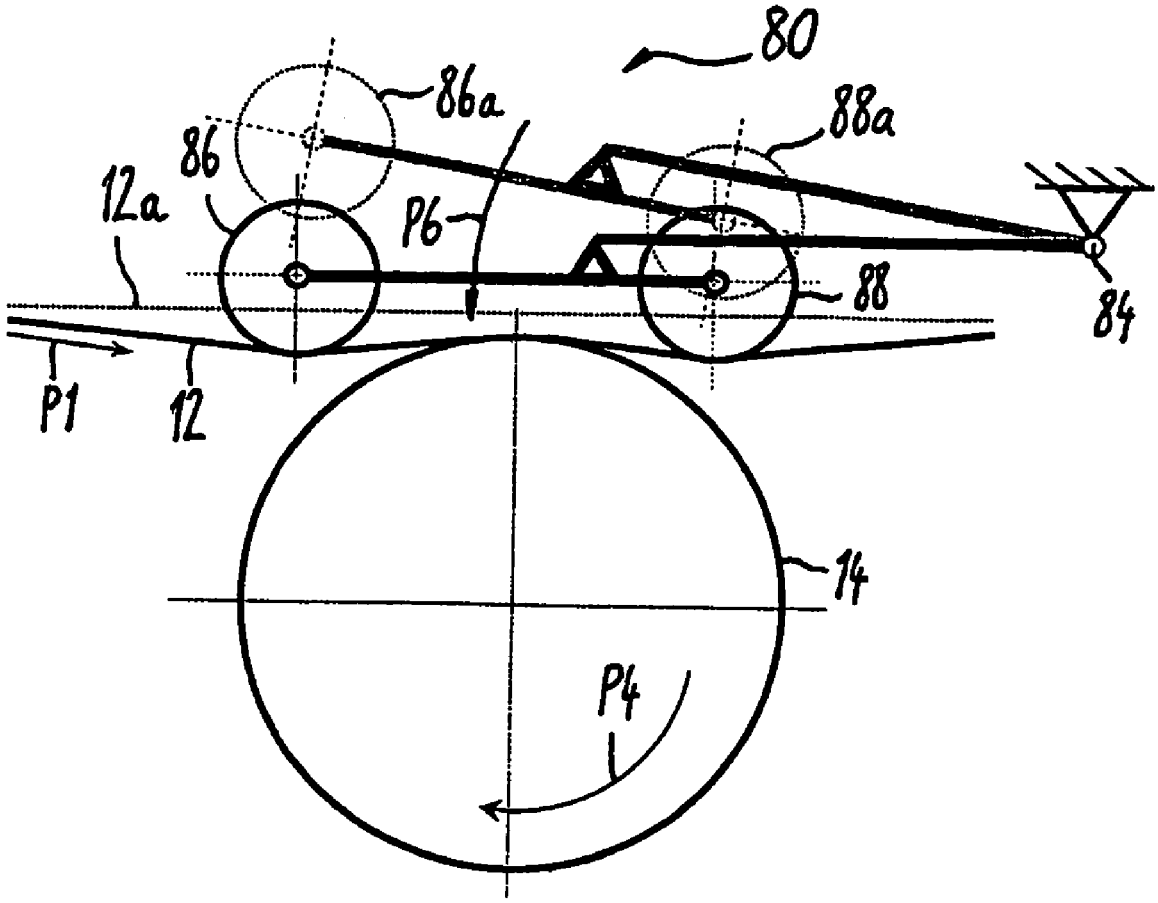
FIG. 6 a section representation of an arrangement for inking of a charge image present on a photoconductor band with a device for directing the photoconductor band towards an applicator roller according to a second embodiment.

As an alternative to the arrangement 70 shown in FIG. 5 for pivoting of the photoconductor band 12 towards the applicator roller 14, in FIG. 6 an alternative arrangement 80 is shown for pivoting the photoconductor band 12 towards the applicator roller 14. The arrangement 80 comprises a pivot frame 82 that can pivot, with the aid of a pivot drive (not shown), around a pivot axis 84 from the pivoted-away position 82*a* into the pivoted-towards position 82 along the arrow P6.

In the pivoted-towards state, a part of the photoconductor band 12 encloses a surface region of the applicator roller 14. In the pivot frame, two rollers 86, 88 are arranged such that they can rotate, which rollers 86, 88 change their position together with the pivot frame 82 given pivoting of the pivot frame 82. The rollers are designated with the reference characters 86, 88 in the pivoted-towards position and with the reference characters 86*a*, 88*a* in the pivoted-away position.

Alternatively, the pivot arrangements according to FIGS. 5 and 6 can be connected with further band guidance elements (in particular with further rollers) via a lever system via which the band tension is kept essentially constant in the pivoted-towards, pivoted-away, and during the pivoting event.

Although a preferred exemplary embodiment has been shown and described in detail in the drawings and in the preceding specification, it should be viewed as purely exemplary and not as limiting the invention. It is noted that only the preferred exemplary embodiment is shown and described, and all changes and modifications that presently and in the future lie within the protective scope of the invention should be protected.

I claim as my invention:

1. A device for inking of a charge image with toner material in a printer or copier, comprising:

a photoconductor band having a surface which comprises a photoconducting layer on which a charge image can be generated corresponding to a print image to be generated;

an applicator roller having a surface on which a layer of toner particles has been applied at least on one region;

a pivot arrangement for pivoting of the photoconductor band towards the applicator roller in a transfer printing region between the photoconductor band and the applicator roller in order to transfer at least one part of the toner particles present on the surface of the applicator roller onto the photoconductor band, and for pivoting the photoconductor band away from the applicator roller in the transfer printing region in order to prevent the transfer of the toner particles present on the surface of the applicator roller onto the photoconductor band;

the pivot arrangement having a first roller over which the photoconductor band is directed before the transfer printing region;

the pivot arrangement having a second roller over which the photoconductor band is directed after the transfer printing region;

the applicator roller surface being curved outwards at a contact point with the photoconductor band, and the photoconductor band being pressed inwards by said outwardly-curved surface due to the pivoting towards the contact point and thereby partially encloses the outwardly-curved surface of the applicator roller; and the applicator roller being at least partially enclosed by the photoconductor band at the contact point as it is moved into the photoconductor band, whereby a depth of immersion lies in a range from 0.5 mm to 8 mm.

2. A device according to claim 1 wherein the photoconductor band and the applicator roller are arranged relative to one another such that, due to the pivoting towards, the surface of the applicator roller contacts the surface of the photoconductor band at a contact point when no toner particles are present on the surface of the applicator roller.

3. A device according to claim 1 wherein the photoconductor band and the applicator roller are designed or arranged such that the surfaces of the photoconductor band and of the applicator roller contact on a section along their transport direction so that a contact point is formed by said section.

4. A device according to claim 3 wherein the section has a length in a range of 0.5 mm to 10 mm.

5. A device according to claim 1 wherein the photoconductor band intersects a common tangent of both rollers at contact points with the first roller and the second roller; and the applicator roller presses the photoconductor band directed over both rollers between both rollers such that the tangent between both rollers intersects the applicator roller, so that a separation between the tangents and a point of the photoconductor band furthest removed from the tangent between both rollers is the immersion depth of the applicator roller.

6. A device according to claim 1 wherein the photoconductor band and the applicator roller are arranged in the printer or copier such that their surfaces are pressed onto one another at at least one contact point with a pre-definable force.

7. A device according to claim 1 wherein an electric field generator is provided between the photoconductor band and the applicator roller at least in a region of the transfer printing point, the field exerting a force on the toner particles in a direction of the photoconductor band, and a field strength of the field being controllable so that the electrical field is a constant electrical field.

8. A device according to claim 6 wherein an alternating electrical field generator is provided between the photoconductor band and the applicator roller, at least in a region of the contact point.

9. A device according to claim 1 wherein the layer of toner particles applied on the applicator roller has a substantially uniform layer thickness that is generated with aid of a particle mixture transported on a surface of a magnet roller.

10. A device according to claim 1 wherein the pivot arrangement changes a position of the photoconductor band such that, in a first operating state, the photoconductor band is pivoted towards the applicator roller such that at least one part of the toner particles applied on the surface of the applicator roller contact the surface of the photoconductor band at a contact point between the photoconductor band and the applicator roller, in a second operating state, the photoconductor band being pivoted away from the applicator roller, the photoconductor band and the applicator roller being arranged at a distance relative to one another, and the toner particles being applied on the surface of the applicator roller not contacting the surface of the photoconductor band.

11. A method for inking of a charge image with toner material in a printer or copier, comprising the steps of:

providing a charge image corresponding to a print image to be generated on a surface of a photoconductor band comprising a photoconducting layer;

applying a layer made up of toner particles at least on one region of a surface of an applicator roller;

moving the photoconductor band towards the applicator roller in a transfer printing region between the photoconductor band and the applicator roller with aid of a moving arrangement in order to transfer at least one part of the toner particles present on the surface of the applicator roller onto the photoconductor band, the applicator roller surface being curved outwards at a contact point with the photoconductor band, the photoconductor band being pressed inwards by said outwardly-curved surface due to the moving towards the contact point and thereby partially encloses the outwardly-curved surface of the applicator roller, the applicator roller being at least partially enclosed by the photoconductor band at the contact point as it is moved into the photoconductor band, whereby a depth of immersion lies in a range from 0.5 mm to 8 mm;

moving the photoconductor band away from the applicator roller in the transfer printing region with aid of the moving arrangement in order to prevent transfer from the surface of the applicator roller onto the photoconductor band;

directing the photoconductor band over a first roller of the moving arrangement before the transfer printing region; and directing the photoconductor band over a second roller of the moving arrangement after the transfer printing region.

12. A device for inking of a charge image with toner material in a printer or copier, comprising:

a photoconductor band having a surface which comprises a photoconducting layer on which a charge image can be generated corresponding to a print image to be generated;

an applicator roller having a surface on which a layer of toner particles has been applied;

a moving arrangement which moves the photoconductor band towards the applicator roller in a transfer printing region between the photoconductor band and the applicator roller in order to transfer at least some of the toner particles present on the surface of the applicator roller onto the photoconductor band, and which moves the photoconductor band away from the applicator roller in the transfer printing region in order to prevent the transfer of the toner particles present on the surface of the applicator roller onto the photoconductor band;

the moving arrangement having a first body over which the photoconductor band is directed before the transfer printing region;

the pivot moving arrangement having a second body over which the photoconductor band is directed after the transfer printing region;

the applicator roller surface being curved outwards at a contact point with the photoconductor band, and the photoconductor band being pressed inwards by said outwardly-curved surface due to the inward movement at the contact point and thereby partially encloses the outwardly-curve surface of the applicator roller; and the applicator roller being at least partially enclosed by the photoconductor band at the contact point as it is moved into the photoconductor band, whereby a depth of immersion lies in a range from 0.5 mm to 8 mm.

* * * * *